US006783304B1

(12) United States Patent
Lee

(10) Patent No.: US 6,783,304 B1
(45) Date of Patent: Aug. 31, 2004

(54) WEATHER RESISTANT DOCK WALKWAY

(76) Inventor: Julian C. Lee, P.O. Box 11141 APO, Grand Cayman, Cayman Islands (KY)

( * ) Notice: Subject to any disclaimer, the term of this patent is extended or adjusted under 35 U.S.C. 154(b) by 0 days.

(21) Appl. No.: 10/716,523

(22) Filed: Nov. 20, 2003

(51) Int. Cl.[7] ..... B63C 1/00

(52) U.S. Cl. ..... 405/219; 405/218; 114/45; 114/263

(58) Field of Search ..... 405/218–221; 114/263, 44, 45

(56) References Cited

U.S. PATENT DOCUMENTS 4,223,629 A * 9/1980 Dunlop ..... 405/219
4,695,195 A * 9/1987 Brande ..... 405/220
4,892,052 A 1/1990 Zook et al.
4,940,021 A * 7/1990 Rytand ..... 405/219
5,048,448 A * 9/1991 Yoder ..... 114/263
5,106,237 A 4/1992 Meldrum
5,623,803 A 4/1997 Willis
5,735,097 A * 4/1998 Cheyne ..... 114/263
5,888,024 A * 3/1999 Mills et al. ..... 405/219
6,128,880 A * 10/2000 Meenan, Jr. ..... 52/489.1
6,409,431 B1 6/2002 Lynch

* cited by examiner

*Primary Examiner*—Frederick L. Lagman
(74) *Attorney, Agent, or Firm*—Richard C. Litman

(57) ABSTRACT

A weather resistant dock walkway comprises a dock walkway substructure in combination with a plurality of elongated planks each with a first and second opposite ends. The planks are rotatable between a horizontal position and a vertical position, and are arranged side-by-side. The first and second opposite ends of each plank are attached to the opposite ends of the substructure. The planks are responsive to contact with a body of water such that the planks rotate from a horizontal position to a vertical position to enable surging water to circulate freely between the vertical planks to prevent surge damage to the weather resistant dock walkway. A ratchet system can be used to reversibly lock the planks in a vertical position.

5 Claims, 6 Drawing Sheets

WEATHER RESISTANT DOCK WALKWAY

BACKGROUND OF THE INVENTION

1. Field of the Invention

The present invention relates to a weather resistant dock-decking system. More specifically, the invention is directed to a dock-decking system with a deck platform disposed upon a deck substructure. The deck platform comprises a plurality of planks that are free to move from a horizontal position to a vertical position to withstand a storm surge.

2. Description of the Related Art

Dock walkways are notoriously vulnerable to severe damage at the hands of severe weather such as violent storms, wave action, storm surge, and high winds. In colder climates docks are particularly vulnerable to ice damage. Ice can cyclically form and thaw leading to substantial gouging and destruction of dock structures. Thus, there is a need for a dock design that is resistant to high winds, waves, and the action of repeated ice formation and thawing.

U.S. Pat. No. 4,892,052 issued Jan. 9, 1990 to Zook et al., describes a deck system for a boat that includes a deck substructure composed of aluminum cross members attachable on pontoons of the boat, and elongated aluminum deck planks to provide a deck platform. The '052 deck system is more akin to a modified pontoon than a true deck system and is not designed specifically to cope with severe surges.

U.S. Pat. No. 5,106,237 issued Apr. 21, 1992 to C. R. Meldrum, describes a submersible dock system with mooring pilings which folds down for storage underwater. The '237 dock system includes a deck or main span normally above water, a submerged horizontal frame and, if necessary, leveling structure and a plurality of vertical support structures extending between the submerged frame and dock; when not in use the '237 dock system can be stored underwater. The '237 dock system does not teach or suggest the dock system of the present invention.

U.S. Pat. No. 5,623,803 issued Apr. 29, 1997 to M. C. Willis, describes a deck structure that utilizes recycled plastic lumber decking planks that slide onto a rigid frame. The frame includes supporting members having protruding "T"-shaped connectors that selectively fit into preformed grooves on the underside of the plastic planks. The manner in which the planks are secured to the frame allows for the expansion and contraction of the individual plank lengths due to temperature variations. Brackets are provided which fasten railings and the like to the rigid frame. The '803 deck does not teach or suggest the weather resistant dock walkway of the present invention.

U.S. Pat. No. 6,409,431 issued Jun. 25, 2002 to T. S. Lynch, describes a submersible floating dock that can be sunk beneath the water line in the event of the approach of a violent storm for protection of the dock against wave action, storm surge, and high winds. The '431 dock is supported on hollow floatation chambers is attached to pilings by rings. As a storm approaches water is allowed to enter the otherwise air filled hollow floatation chambers. This causes the '431 dock and deck to sink beneath the water line making it resistant to damage from storm surge, wave action, and high winds. The '431 is a complex design that relies on an air compressor pump and air tight valves; such mechanical equipment is expensive to maintain. Thus, there is a need for a deck that does not rely on expensive compressor pumps and valves.

None of the above inventions and patents, taken either singly or in combination, is seen to describe the instant invention as claimed. Thus a dock solving the aforementioned problems is desired.

SUMMARY OF THE INVENTION

A weather resistant dock-decking system that comprises a deck platform disposed upon a deck substructure having opposite ends. The deck platform comprises a plurality of elongated planks that are free to move from a horizontal position to a vertical position to withstand a storm surge. The plurality of elongated planks each have a first and second opposite ends. The planks are rotatable between a horizontal position and a vertical position, and are arranged side-by-side. The first and second opposite ends of each plank are attached to the opposite ends of the substructure. The planks are responsive to contact with a body of water such that the planks rotate from a horizontal position to a vertical position to enable surging water to circulate freely between the vertical planks to prevent surge damage to the weather resistant dock walkway. A ratchet system can be used to reversibly lock the planks in a vertical position; user intervention to disengage the ratchet system allows the planks to return to their default horizontal orientation.

Accordingly, it is a principal object of the invention to provide a weather resistant dock walkway.

It is another object of the invention to provide a weather resistant dock walkway that is responsive to surge conditions.

It is a further object of the invention to provide a weather resistant dock walkway that comprises of a plurality of planks adapted to adopt a vertical position in response to surge conditions.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a weather resistant dock-decking system 100. More specifically, the invention is directed to a dock-decking system 100 with a deck platform 120 disposed upon a deck substructure 140. The deck platform 120 comprises a plurality of planks 160 that are free to move from a horizontal position to a vertical position to withstand a storm surge. The terms "dock-decking system" and "dock walkway" are hereinafter regarded as equivalent terms.

Figure 1:
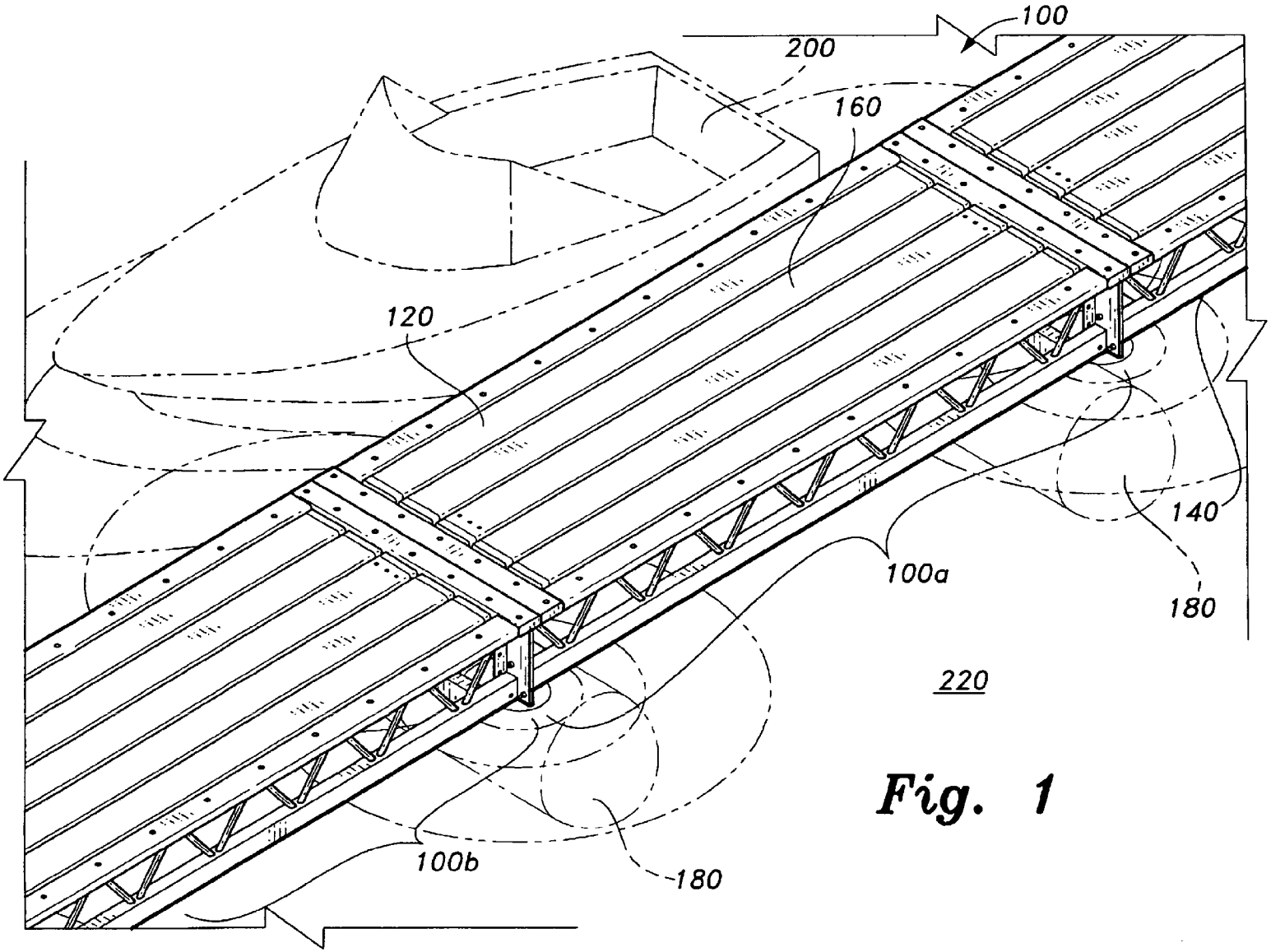
FIG. 1 is an environmental, perspective view of a weather resistant dock walkway according to the present invention.

FIG. 1 shows an environmental perspective view of the weather resistant dock-decking system 100. The weather resistant dock-decking system 100 comprises a deck platform 120 disposed upon a deck substructure 140 (see FIG. 4) The deck platform 120 comprises a plurality of planks 160 that are free to move from a horizontal position to a vertical position to withstand a storm surge (see FIG. 2). The substructure 140 rests upon any suitable support such as floating supports in the form of cylindrical pontoons 180 and concrete pillars 185 (see FIG. 2). The dock-decking system 100 typically comprises a plurality of sections (represented by "100*a*" and "100*b*" in FIG. 1) linked together in series. The dock-decking system 100 provides an ideal way for a person to access water devices such as a boat 200 floating on a body of water 220.

Figure 2:
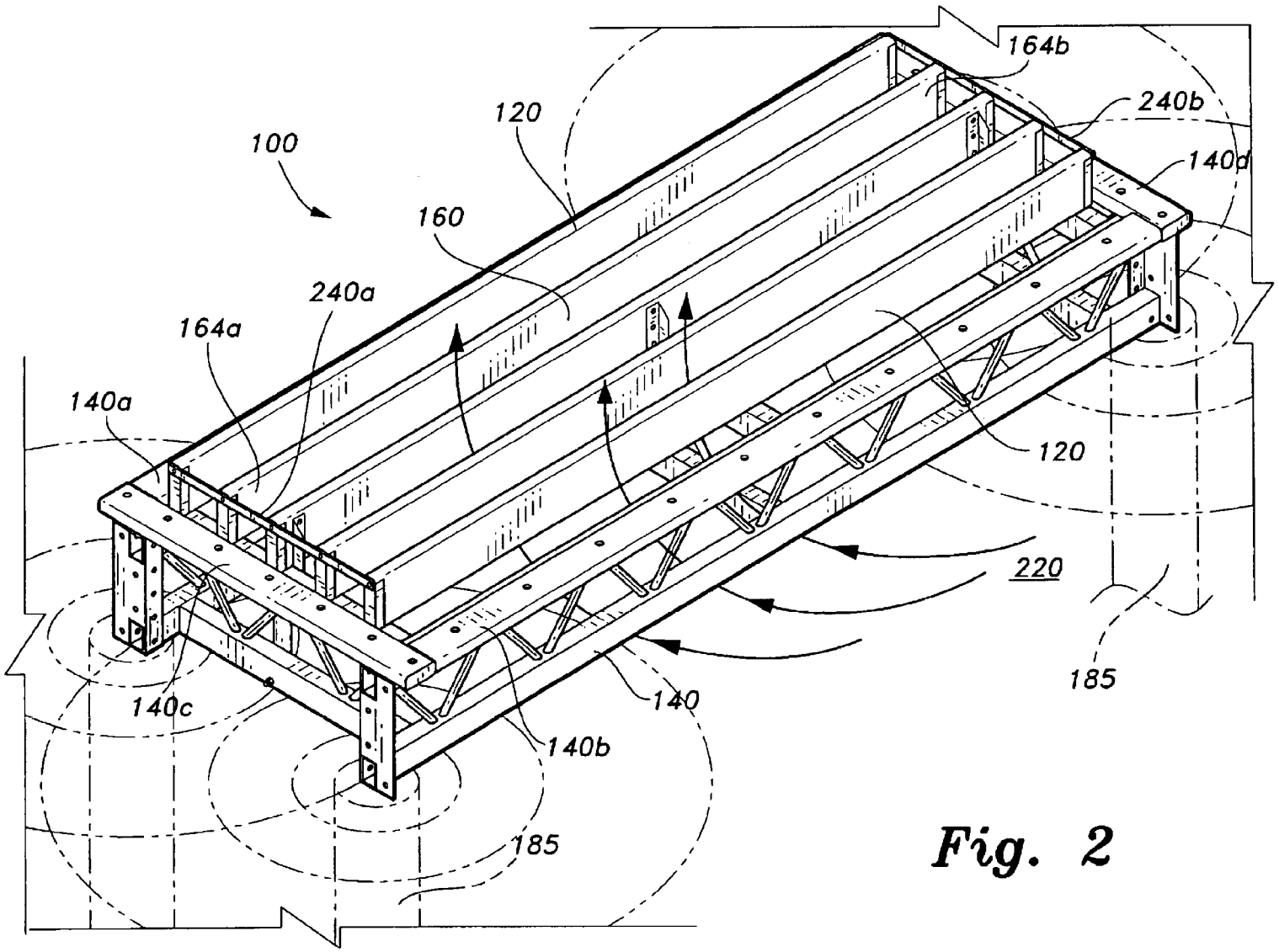
FIG. 2 is a perspective view of the weather resistant dock walkway during surge conditions.

Referring to FIG. 2, the deck platform 120 is disposed upon the substructure 140, wherein the deck platform 120 comprises a plurality of elongated planks 160 each with a first 164*a* and second 164*b* opposite ends. The planks 160 are rotatable between a horizontal position and a vertical position, and are arranged side-by-side along the substructure 140.

Still referring to FIG. 2, the substructure 140 is of general rectangular planar shape with opposite lateral sides 140*a* and 140*b*, and opposite ends 140*c* and 140*d*. The planks 160 are arranged in side by side and in parallel with respect to the lateral sides 140*a* and 140*b* as shown in FIG. 2. The opposite ends 164*a* and 164*b* of the planks 160 are attached to the opposite ends 140*c* and 140*d* of the substructure 140, respectively. The ends 164*a* of each plank 160 are operably connected by an elongated member 240*a*, and likewise the ends 164*b* of each plank 160 are operably connected by an elongated member 240*b*.

In an alternative embodiment, the plank ends 164*a* and 164*b* are not operably connected together by elongated member 240*a* and 240*b*, respectively. In this alternative arrangement, the planks 160 are free to rotate between a horizontal default positions to a vertical position in response to a storm surge. Absent a storm surge, the planks 160 are biased to return to their horizontal orientation.

Figure 3:
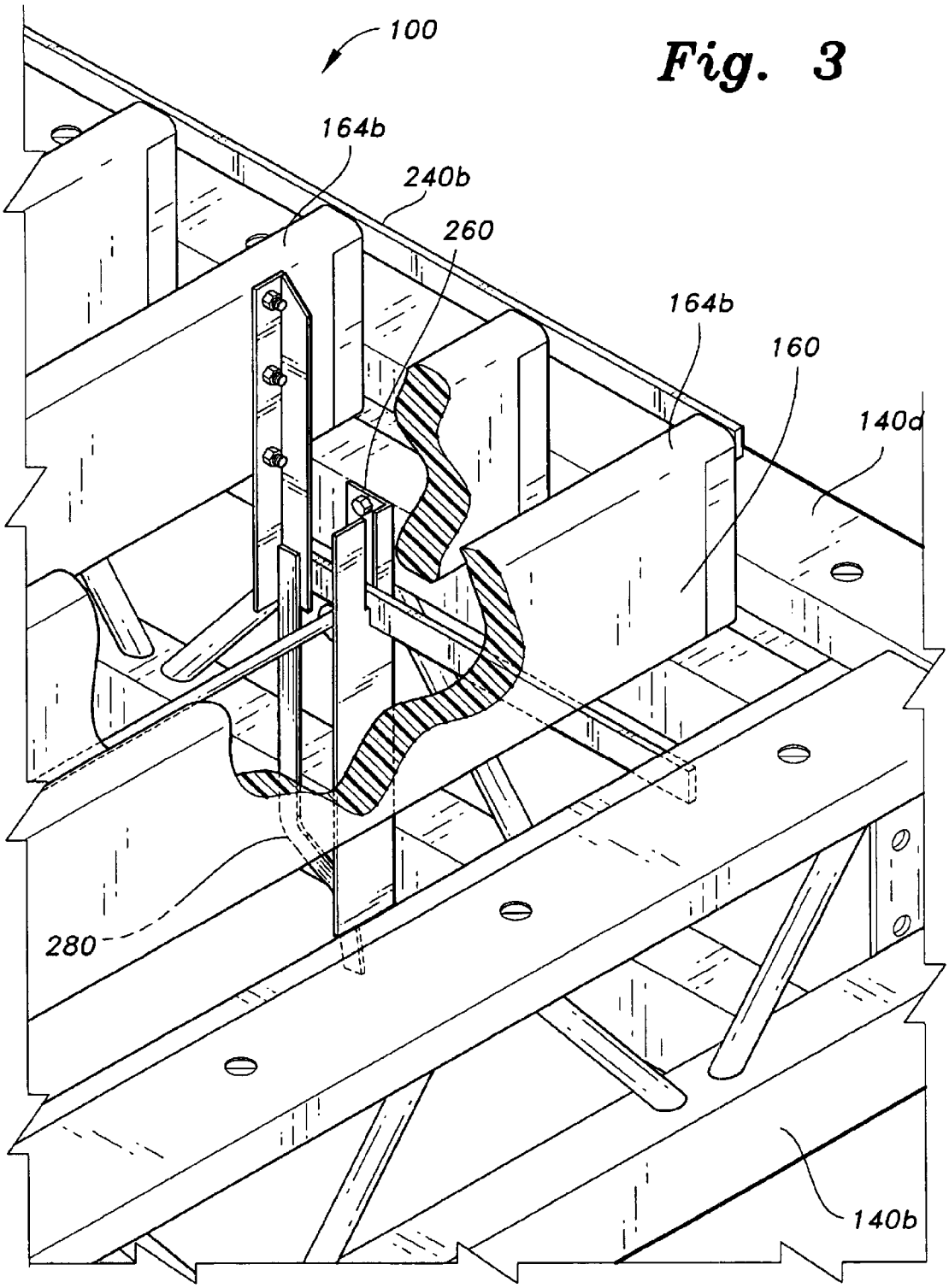
FIG. 3 is a fragmented view of a ratchet system configured to reversibly hold plank members in a vertical position.

FIG. 3 shows a fragmentary cut-away view of a ratchet system 260 used in the preferred embodiment of the present invention. The ratchet system 260 is responsive to the position of the planks 160 such that when the planks 160 adopt a vertical position the planks 160 are locked in the vertical position by the ratchet system 260. To release the planks 160 from their vertical position a person operates a lever 280 to cause the planks 160 to return to their horizontal position. Thus, during a storm surge water 220 can surge under the deck platform 120 and apply potentially destructive upward pressure on the planks 160, but instead of causing damage to the deck 120 the planks 160 respond to the upward pressure by moving from a horizontal orientation to a vertical position thereby allowing the surge water to flow between the vertical planks as shown in FIG. 2.

Figure 4:
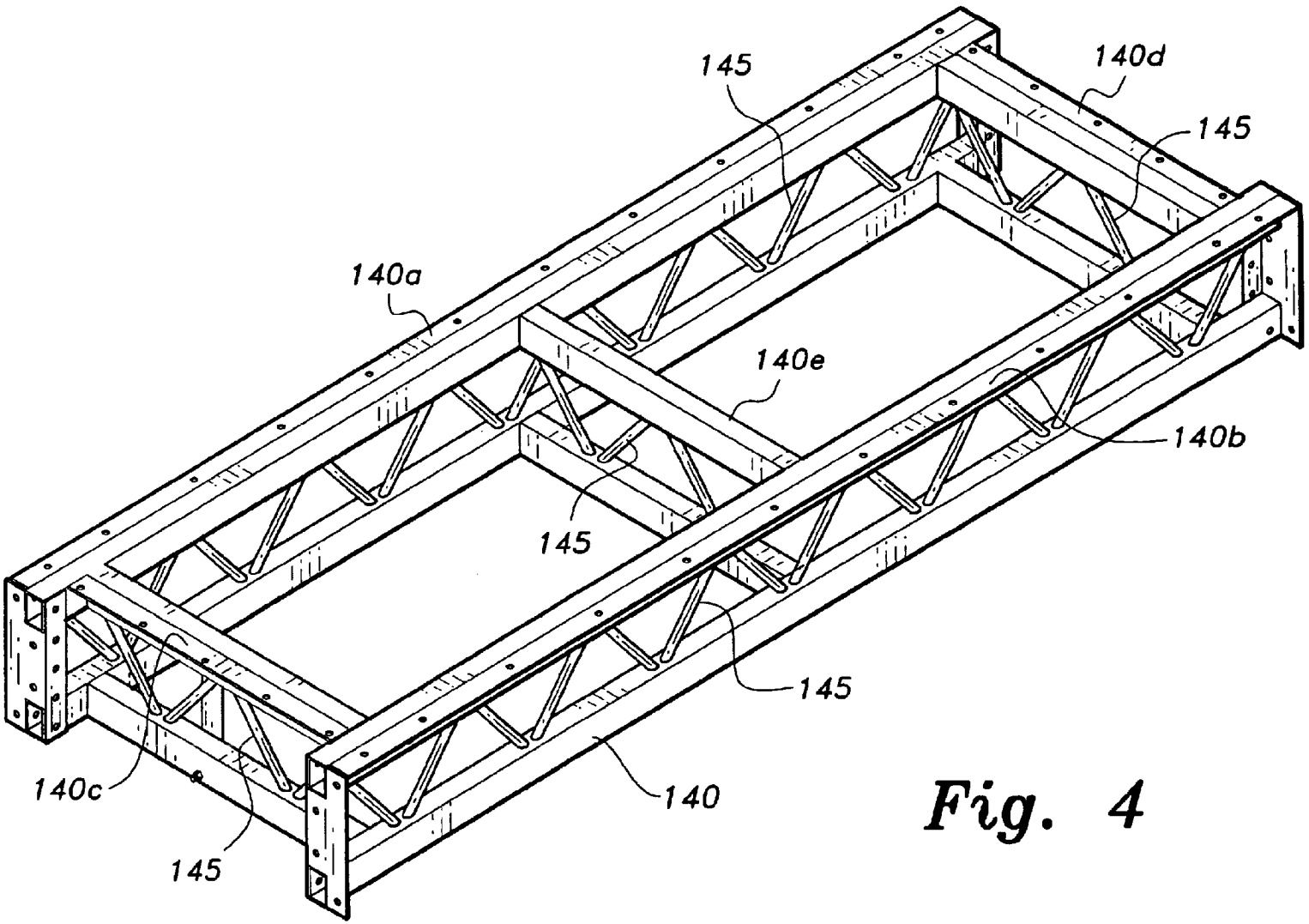
FIG. 4 shows a perspective view of a deck substructure according to the present invention.
Figure 5A:
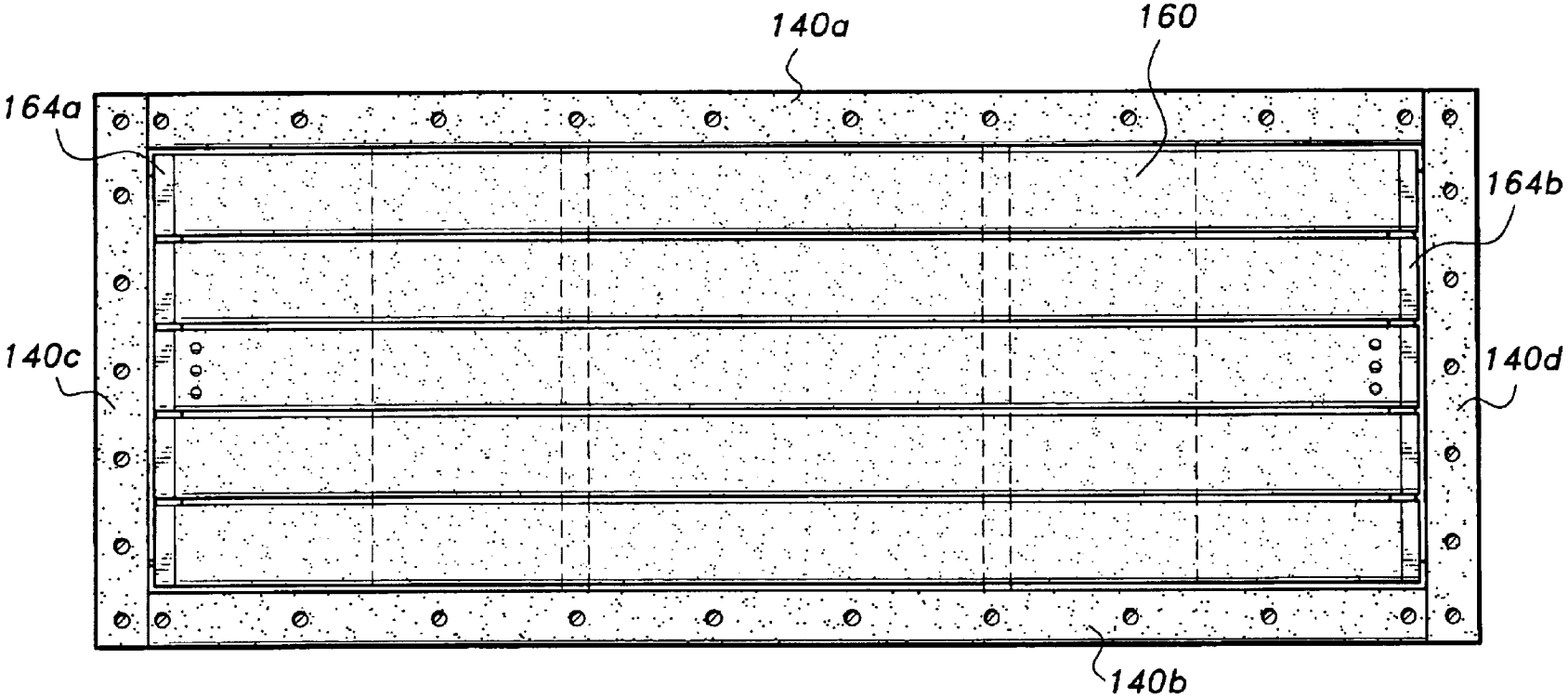
FIG. 5A shows a top view of a weather resistant dock walkway according to the present invention.
Figure 5B:
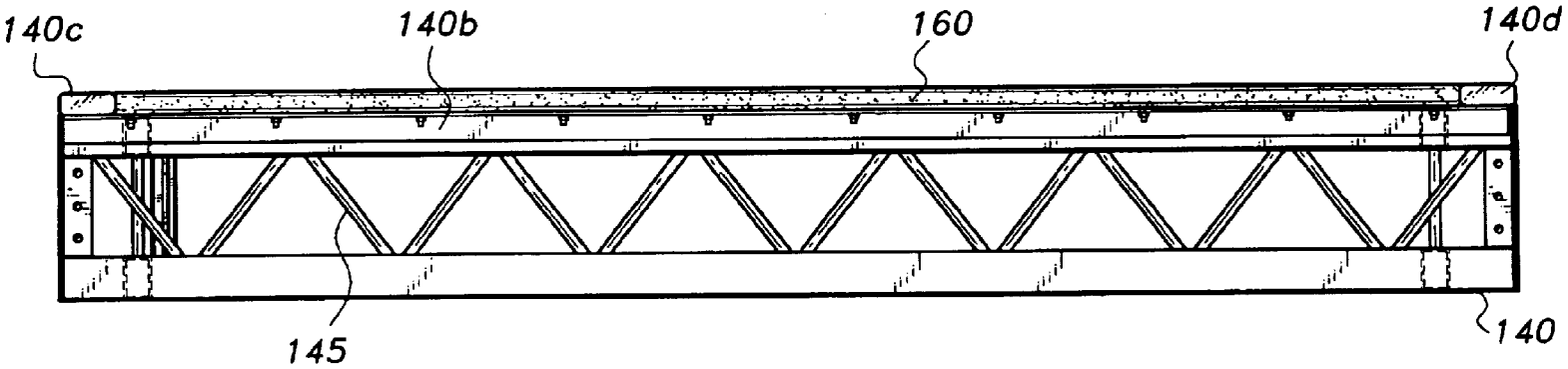
FIG. 5B shows a side view of a weather resistant dock walkway according to the present invention.
Figure 5C:
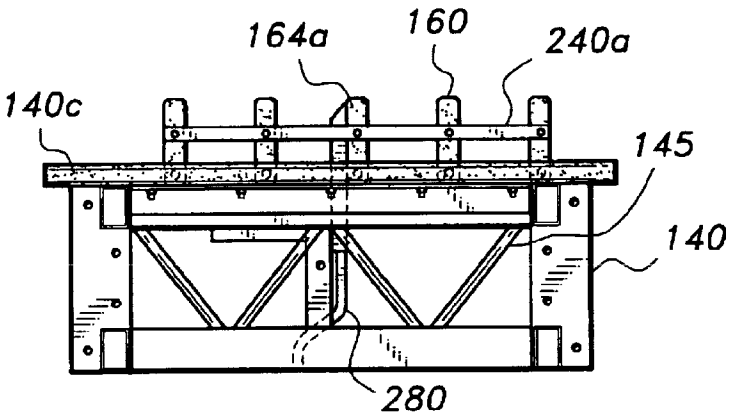
FIG. 5C shows an end view of a weather resistant dock walkway according to the present invention.

FIG. 4 shows a perspective view of the deck substructure 140 upon which the planks 160 are laid. The substructure 140 may be made of any suitable material such as aluminum. The planks 160 may be made of any suitable material such as weather treated wood, and UV resistant polymer. The substructure 140 may be reinforced with diagonal bracing members 145. The bracing members 145 may be made of any suitable material such as columns of aluminum. The form of bracing may vary; for example, the bracing may take the form of a plurality of triangular bracing members welded to the ends of the substructure 140. A cross member 140e helps maintain structural integrity. FIGS. 5A, 5B, and 5C show a top, side, and end view of the deck substructure 140 according to the present invention.

It is to be understood that the present invention is not limited to the embodiments described above, but encompasses any and all embodiments within the scope of the following claims.

I claim:

1. A weather resistant dock walkway, comprising:

a deck substructure;

a deck platform disposed upon the substructure, wherein the deck platform comprises a plurality of elongated planks each with a first and second opposite ends, the planks are rotatable between a horizontal position and a vertical position, and are arranged side-by-side above the substructure; and whereby, the planks are responsive to contact with a body of water such that the planks rotate from a horizontal position to a vertical position to enable surging water to circulate freely between the vertical planks to prevent surge damage to the weather resistant dock walkway.

2. The weather resistant dock walkway according to claim 1, further comprising a ratchet system responsive to the position of the planks such that when the planks adopt a vertical position they are locked in the vertical position by the ratchet system.

3. The weather resistant dock walkway according to claim 1, further comprising a plurality of piles to support the weather resistant dock walkway.

4. The weather resistant dock walkway according to claim 1, further comprising a plurality of floats to support the weather resistant dock walkway.

5. A weather resistant dock walkway, comprising:

a deck substructure of overall rectangular shape with a first and second opposite ends, and a first and second opposite lateral sides;

a deck platform disposed upon the substructure, wherein the deck platform comprises a plurality of elongated planks each with a first and second opposite ends, and are arranged side-by-side above the substructure, the opposite ends of the planks are respectively operably connected to a first and second elongated member, and further wherein the opposite ends of the planks are respectively connected to the first and second opposite ends of the substructure in such fashion that the planks are able to rotate between a horizontal and a vertical position;

a ratchet system having a lever, wherein the ratchet system locks the planks in a vertical position upon rotation of the planks to a vertical position and which requires human intervention to unlock the planks by moving the lever to allow the planks to return to a horizontal position; and whereby, the planks are responsive to contact with a body of water such that the planks rotate collectively from a horizontal position to a vertical position and lock in the vertical position under the influence of the ratchet system to enable surging water to circulate freely between the vertical planks to prevent surge damage to the weather resistant dock walkway.

* * * * *